US008534788B2

(12) United States Patent
Masada et al.

(10) Patent No.: US 8,534,788 B2
(45) Date of Patent: Sep. 17, 2013

(54) RECORDING APPARATUS AND RECORDING METHOD

(75) Inventors: Yohei Masada, Kawasaki (JP); Yoshitomo Marumoto, Yokohama (JP); Hiromitsu Yamaguchi, Yokohama (JP); Hitoshi Tsuboi, Kawasaki (JP); Ryota Kato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 430 days.

(21) Appl. No.: 13/015,473

(22) Filed: Jan. 27, 2011

(65) Prior Publication Data

US 2011/0187775 A1 Aug. 4, 2011

(30) Foreign Application Priority Data

Jan. 29, 2010 (JP) ..... 2010-019440

(51) Int. Cl.
*B41J 29/38* (2006.01)
*B41J 2/15* (2006.01)
*B41J 2/145* (2006.01)

(52) U.S. Cl.
USPC ..... 347/12; 347/41

(58) Field of Classification Search
USPC ..... 347/12
See application file for complete search history.

(56) References Cited

U.S. PATENT DOCUMENTS

2007/0236525 A1 10/2007 Noguchi
2009/0040550 A1 2/2009 Marumoto

FOREIGN PATENT DOCUMENTS

JP 2007-276353 A 10/2007
JP 2007-301989 A 11/2007
JP 2009-39944 A 2/2009
JP 2009039944 * 2/2009

* cited by examiner

*Primary Examiner* — Uyen Chau N Le
*Assistant Examiner* — Kajli Prince
(74) *Attorney, Agent, or Firm* — Canon U.S.A., Inc. IP Division

(57) ABSTRACT

When a number of passes of multi-pass recording has been changed, a repetitive cycle of a drive pattern is changed, depending on change of feeding amount caused by change of the number of passes. Accordingly, the drive pattern is set to a size corresponding to the changed feeding amount.

10 Claims, 13 Drawing Sheets

RECORDING APPARATUS AND RECORDING METHOD

BACKGROUND OF THE INVENTION

1. Field of the Invention

The present invention relates to a recording apparatus and a recording method that records an image using a recording head provided with a plurality of recording elements.

2. Description of the Related Art

A recording head in an inkjet recording apparatus is provided with a plurality of nozzles (discharge ports) for discharging an ink, and discharge pressure generating elements (recording elements) are provided within respective nozzles. A high-quality of images, and a high-speed of recording are realized by arranging the plurality of nozzles in a high density.

Normally, ink droplets cannot be discharged at the same time from all of a plurality of nozzles of an inkjet recording head, and recording is performed at timings of the ink droplets discharge that are shifted for every group of a predetermined number of nozzles. As a method for shifting the discharge timings for every group of the predetermined number of nozzles, every group of the predetermined number of the nozzles is divided into sections based on physical positions of the nozzle arrays of the inkjet recording head, and drive timings of the discharge pressure generating elements of the nozzles within the divided sections are shifted from one another. In order that all nozzles within the section are driven within a predetermined period of time in a state where drive timings are shifted, each section is divided into a plurality of blocks, and the discharge pressure generating elements are driven in a time-division fashion for each block. When the discharge pressure generating elements are time-division driven for each block, the same block is simultaneously driven. As a result, inks are simultaneously discharged from one nozzle of each section. Such a time-division driving scheme is effective to make compact a power source for driving the inkjet recording head and power source members such as connectors or cables.

Now then, a number of nozzles that constitute the nozzle array of the recording head tends to increase year after year, and a recording head having a plurality of nozzle arrays in which a plurality of nozzles are arranged has come into use. Japanese Patent Application Laid-Open No. 2007-276353 discusses a method for recording image data (dot data) for one column by allocating it to a plurality of nozzle arrays. According to the recording method, in a case of recording the data, for example, by allocating it to two rows of the nozzle arrays, even if a driving frequency of each of the nozzle arrays is the same as that in a case of recording by only one row of the nozzle array, a recording speed can be doubled by doubling a scanning speed of the nozzle arrays. Further, if two rows of the nozzle arrays are used, one nozzle array is used only half a number of times to record a certain amount of region, for example, a region for one-scan, and as a result, lifetime of the recording head becomes longer.

Processing for distributing the dot data to a plurality of nozzle arrays such as two rows, or three rows or more is performed by, for example, a configuration illustrated in FIG. 1. FIG. 1 illustrates a configuration in which the image data (dot data) is divided for use in what is called multi-pass recording, and the recording head is driven based on the divided dot data, thereby carrying out recording. In FIG. 1, the image (dots) data input in step S201 is subjected to mask processing in step S202, and the dot data for a plurality of times of scans is generated. Then, in step S203, the divided dot data for the plurality of scans is assigned to the nozzles of respective nozzle arrays. Assignment of the dot data to the nozzle arrays is performed according to predefined pattern. In the present specification, the pattern is referred to as "drive pattern".

FIG. 2 is a schematic diagram illustrating drive patterns for assigning discharge data to two rows of nozzle arrays. An example illustrated in FIG. 2 represents two nozzle arrays 1A and 1B that discharge same-colored inks, each having 16 pieces of nozzles arranged with an interval of 1200 dpi in a nozzle arrangement direction (in a vertical direction in FIG. 2). Nozzle numbers 1 to 16 beginning at the top nozzle are assigned to each of the nozzle arrays 1A and 1B. Further, an image to be recorded is what is called "solid image" (image in which ink dots are recorded in all areas (unit region where ink dots are recorded)) with a resolution of 1200 dpi. Then, a driving frequency of each nozzle of the nozzle arrays 1A and 1B corresponds to discharging with an area interval equivalent to 600 dpi at one time. In a case of a multi-pass recording, images assigned to two nozzle arrays correspond to images divided corresponding to a plurality of times of scans. In the above-described solid image, ink dots are recorded in areas of division ratio according to a number of times of scans, in each scanning. However, in the descriptions hereinbelow with reference to FIG. 2, in order to make descriptions easy to understand, a case will be described where the solid image is recorded by one scanning operation as an example.

In FIG. 2, with regard to the nozzle array 1A, the dot data is assigned according to the drive pattern "A", and with regard to the nozzle array 1B, the dot data is assigned according to the drive pattern "B". Block enable signals for performing time-division driving operation are input into the nozzle arrays 1A and 1B in the order from a nozzle with nozzle number 1 to a nozzle with nozzle number 16, and logical (AND) products with the dot data assigned according to the drive patterns are performed, and each of the recording elements is driven. More specifically, when a column (area array in the vertical direction in FIG. 2) 0 is recorded, in the nozzle array 1A, the recording elements corresponding to the nozzles with nozzle numbers {1,2}, {5,6,7}, {9,10}, {14} are driven in this order. On the other hand, in the nozzle array 1B, the recording elements corresponding to the nozzles with the nozzle numbers {3,4}, {8}, {11,12,13}, {15,16} are driven in this order. When the column 1 is recorded, both the nozzle arrays 1A and 1B record by the time-division driving using complementary nozzles excluding the nozzles used in the column 0. For the column 2 or later, the dot data of the column 0, and the dot data of the column 1 are alternately assigned.

In this way, even when respective nozzles are driven at a driving frequency to perform discharge with 600 dpi interval at one time, a drive equivalent to a driving frequency for discharging with 1200 dpi interval at one time can be performed. As a result, it becomes possible to record high-resolution images without slowing down recording speeds.

In the time-division driving scheme, an order of the recording elements to be driven exerts influence upon discharge performance of a head. More specifically, when liquid droplets are discharged from a certain nozzle, pressure wave of an ink is produced in a part which communicates with the nozzle, thereby causing an ink oscillation depending on a discharge frequency. The closer the part is to a generating source of oscillation, the larger the influence exerted by the oscillatory wave becomes, and adjoining nozzles are most susceptible to the oscillatory wave. Due to the influence, discharge state or discharge amount of the discharged ink becomes unstable. As a result, this may bring about poor image quality such as density (concentration) unevenness on the recorded images. For example, if the liquid droplets are discharged when a liquid level of the nozzle comes down, an ink mist becomes liable to be produced, which leads to deterioration of image quality of the recorded images. Further, energy with which the ink is discharged becomes larger, and thus lifetime of the head will be shortened. For this reason, a driving order of blocks is set such that occurrence of a phenomenon as described above is hindered.

Now, if the nozzle arrays are arranged in a plurality of rows, and the recording speed is multiplied, a beading problem may arise in the recorded images. More specifically, since the speed-up of the recording involves an increased amount of ink to be applied per unit time and per unit area of the recording medium, an ink absorption rate of the recording medium cannot respond to the application rate. Thus ink droplets which are not absorbed on the surface of the recording medium may come into contact with one another. Then, inks which have been combined by the contact and become relatively large are conspicuous in a finally obtained image, which may deteriorate image quality.

Conventionally, various recording methods and mask patterns for preventing the beading have been discussed. In Japanese Patent Application Laid-Open No. 2009-39944, for example, there is described a use of mask designed to attain a high dispersability of dot arrangement which the nozzle array records by one-time scan in a multi-pass recording. According to this patent, by the high dispersability of the recorded dots between the divided patterns, chances that inks come into contact with one another by the one-time scan can be reduced. That is, a beading problem which deteriorates image quality can be alleviated.

However, the image data is not divided only by the mask patterns, but the image data is also divided by the drive patterns. In this case, if a size in a conveyance direction of the drive pattern stays constant, the following problem arises. More specifically, if the recording data is allocated based on the drive pattern, images are formed at a repetitive cycle depending on the size of the drive pattern. However, when a conveyance amount of multi-pass recording at one time is not an integral multiple of the size in the conveyance direction of the drive pattern, the drive patterns of the recording head will vary from scan to scan in the unit region. At this time, interference will occur between the mask patterns and the drive patterns, and dot dispersability of images will be degraded, thereby the dots become prone to coming into contact with one another, and the above-described beading may occur.

SUMMARY OF THE INVENTION

The present invention is directed to alleviating deterioration of image quality due to beading, by varying drive patterns depending on conveyance amounts, in a recording apparatus that performs recording using a plurality of nozzle arrays.

According to an aspect of the present invention, a recording apparatus that performs recording using a plurality of nozzle arrays for discharging same-colored inks, the recording apparatus includes a driving unit configured to divide recording elements provided corresponding to nozzles into a plurality of blocks, with respect to each of the plurality of nozzle arrays, and to drive every group of recording elements that belong to same blocks, an allocation unit configured to allocate dot data to the plurality of nozzle arrays according to drive pattern that defines an area where driving of the recording elements by the driving unit is permitted, and a control unit configured to perform recording in a first recording mode for performing recording by conveying a recording medium by a first conveyance amount in a conveyance direction, or in a second recording mode for performing recording by conveying the recording medium by a second conveyance amount which is non-integral multiple of the first conveyance amount in the conveyance direction. The allocation unit allocates the dot data according to the drive pattern having a size in the conveyance direction which is equivalent to a submultiple of the first conveyance amount in the first recording mode, and allocates the dot data according to the drive pattern having a size in the conveyance direction which is equivalent to a submultiple of the second conveyance amount in the second recording mode.

According to another aspect of the present invention, a method for performing recording by dividing recording elements provided corresponding to nozzles into a plurality of blocks and driving each group of recording elements belonging to same blocks, with regard to a plurality of nozzle arrays for discharging same-colored inks, the method includes allocating dot data to the plurality of nozzle arrays according to drive pattern that defines an area where driving of the recording elements is permitted, and performing recording in a first recording mode for performing recording by conveying a recording medium by a first conveyance amount in a conveyance direction, or in a second recording mode for performing recording by conveying the recording medium by a second conveyance amount of a non-integral multiple of the first conveyance amount in the conveyance direction. In the allocating, allocating the dot data is allocated according to the drive pattern having a size in the conveyance direction equivalent to a submultiple of the first conveyance amount, in the first recording mode, and the dot data is allocated according to the drive pattern having a size in the conveyance direction equivalent to a submultiple of the second conveyance amount, in the second recording mode.

With the above-described configuration, deterioration of image quality due to beading can be alleviated, by varying drive patterns depending on conveyance amounts, in a recording apparatus that performs recording using a plurality of nozzle arrays.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A printer as an inkjet recording apparatus according to the present exemplary embodiment can execute a plurality of recording modes in which numbers of passes of multi-pass recording are different, using a recording head having a plurality of nozzle arrays each having a plurality of nozzles arranged therein. Then, recording modes in which numbers of passes at least have non-integral multiple relationship (e.g., 2-pass and 3-pass) are included in the plurality of recording modes. The present exemplary embodiment, as described below, is supposed to change repetitive cycles of the drive patterns associated with a plurality of nozzle arrays, in accordance with a conveyance amount (hereinafter, also referred to as feeding amount) of the recording medium depending on the number of passes of each recording mode.

Figure 3:
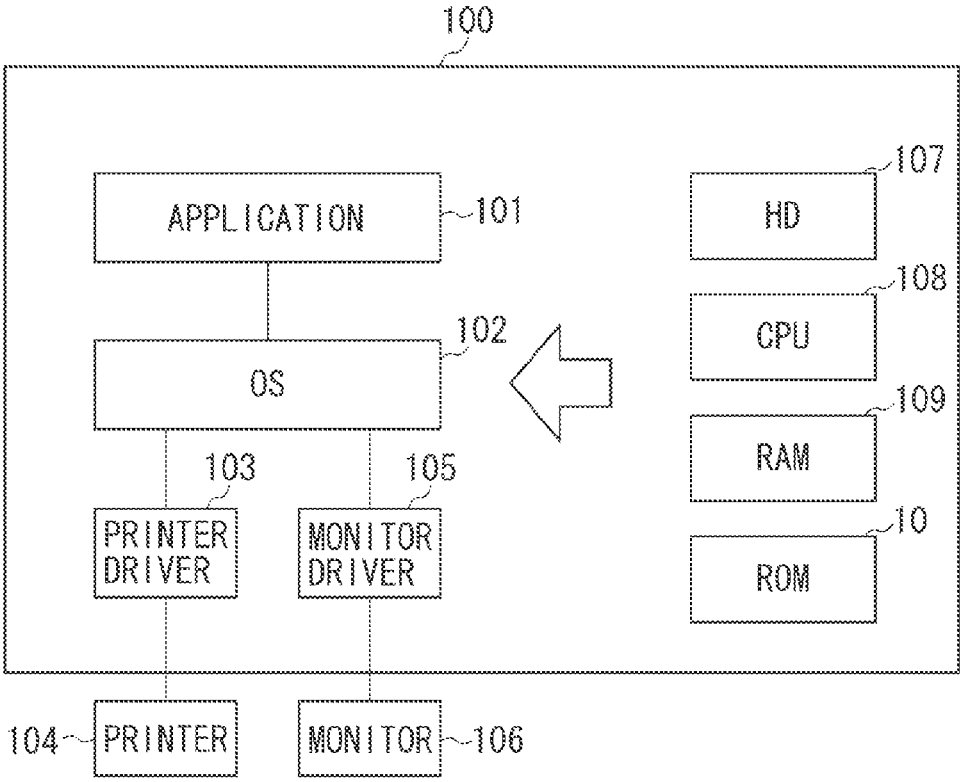
FIG. 3 is a block diagram of an image processing apparatus according to a first exemplary embodiment.

FIG. 3 is a block diagram mainly illustrating hardware and software configuration of a personal computer (hereinafter, simply referred to as PC) as an image processing apparatus according to the exemplary embodiments of the present invention.

In FIG. 3, a PC 100 as a host computer causes an operating system (OS) 102 to operate each software of application software 101, a printer driver 103, and a monitor driver 105. The application software 101 performs processing relating to a word processor, a spreadsheet, the Internet browser, and so forth. The monitor driver 105 executes processing for generating image data to be displayed on a monitor 106, and other processing.

The printer driver 103 performs rendering processing on various types of rendering command groups (image rendering command, text rendering command, graphics rendering command, etc.) issued from the application software 101 to the OS 102, and finally generates the image data to be used in the printer 104. More specifically, the printer driver 103 generates index data for respective color components of cyan (C), magenta (M), yellow (Y), and black (K) of inks to be used in the printer 104, by executing image processing as will be described below in FIG. 4 or later. In the printer 104, dot arrangement patterns are output, depending on the index data based on respective values (levels).

The host computer 100 includes, as various types of hardware for operating the above software, a central processing unit (CPU) 108, a hard disk (HD) 107, a random-access memory (RAM) 109, a read-only memory (ROM) 110, and the like. More specifically, the CPU 108 executes the processing according to the above-described software program stored in the hard disk 107 or the ROM 110, and the RAM 109 is used as a work area when the processing is executed.

The printer 104 as the recording apparatus is what is termed a serial type printer, which causes the recording head, which discharges inks, to scan the recording medium, to discharge the inks in the meantime, thus carrying out recording. The recording heads are prepared corresponding to each ink of C, M, Y, and K, and these are mounted on a carriage, thereby capable of scanning the recording medium such as recording sheet. Each recording head has an arrangement density of the discharge port of 1200 dpi, and discharges 2 pico litter (pl) ink droplets from each discharge port.

Figure 4:
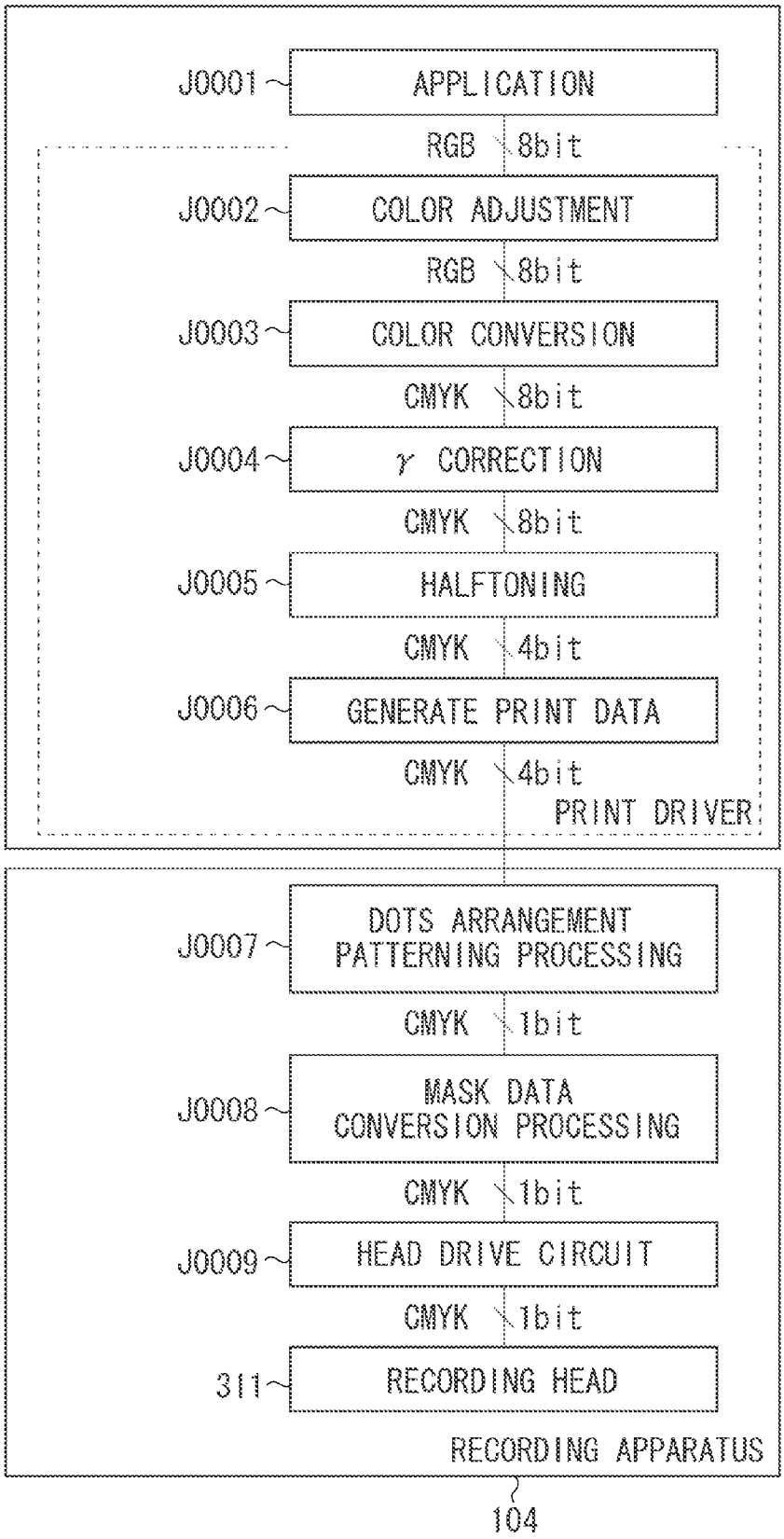
FIG. 4 is a block diagram for explaining a flow of image data conversion processing according to the first exemplary embodiment.

FIG. 4 is a block diagram for explaining a flow of conversion processing of the image data, in the recording system according to the present exemplary embodiment. As described above in FIG. 3, the printer (the recording apparatus) according to the present exemplary embodiment includes each recording head 311 for discharging four-color inks of C, M, Y, and K. Each processing illustrated in FIG. 4 is executed in the printer and the personal computer (PC) serving as a host apparatus.

Application software J0001 executes processing for generating the image data to be recorded by the printer. Then, when the recording is performed, the image data generated by the application software J0001 is passed to the printer driver 103. The printer driver 103 has, as the processing thereof, color adjustment processing J0002, color conversion processing J0003, γ correction J0004, half toning J0005, and print data creation J0006. Hereinbelow, each processing will be briefly described.

The color adjustment J0002 performs mapping of gamut. The aim of the processing is to perform data conversion for mapping gamut reproduced by the image data R, G, B of sRGB specification, into gamut reproduced by the printer. More specifically, the color adjustment J0002 converts data of 256 gradations in which each of R, G, B is expressed in 8-bit into each 8-bit R, G, B data with different gamut, by using three-dimensional LUT (lookup table).

The color conversion J0003 obtains each 8-bit color separation data Y, M, C as a combination of inks which reproduce colors that the data represents, based on the R, G, B data on which mapping of the above-described gamut has been performed. Similar to the first-stage processing herein, the color conversion J0003 performs conversion by using the three-dimensional LUT in conjunction with an interpolation calculation.

The γ correction J0004, for each color component of color separation data obtained by second-stage processing J0003, performs density (concentration) value (gradation value) conversion thereof. More specifically, the γ correction J0004 performs conversion in which the above-described color separation data is linearly associated with gradation characteristics of the printer, using the one-dimensional LUT.

The half toning J0005 performs quantizing processing on each of 8-bit color separation data Y, M, C, to quantize it into 4-bit data. In the present exemplary embodiment, the half toning J0005 converts 8-bit data representing 256 gradation values into 4-bit data representing 5 gradation values using multivalued error diffusion method. The 4-bit data is gradation value information that becomes index of conversion processing into dot arrangement patterns as binarizing processing in the printer.

The print data creation processing J0006 adds print control information to print image information which contains the above-described 4-bit index data to create the print data.

When the print data is sent to the printer through the above-described processing by the host apparatus, the printer performs dot arrangement patterning processing J0007 and mask data conversion processing J0008 on the input print data.

The dot arrangement patterning processing J0007 performs binarizing processing by outputting dot arrangement patterns, based on 9-value index data. Accordingly, binary information can be obtained, about whether to discharge inks which the printer uses when performing recording operation.

Figure 5:
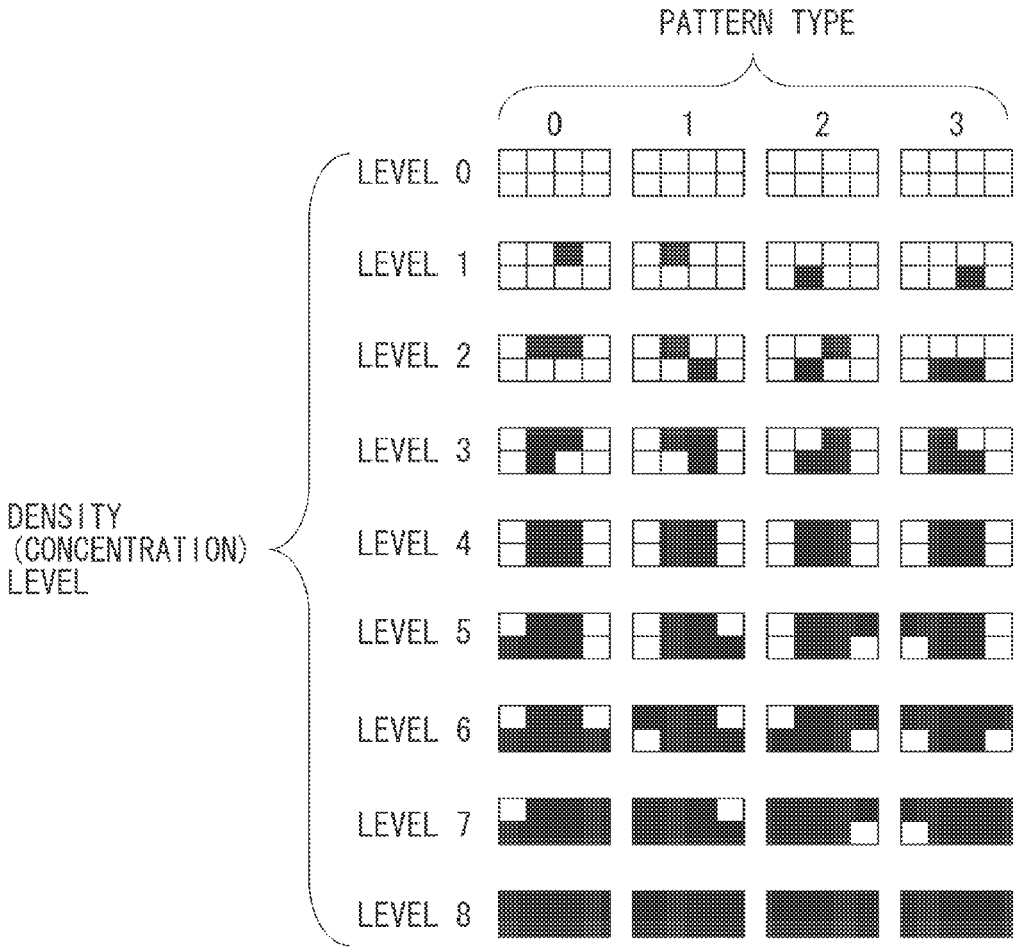
FIG. 5 is a diagram illustrating dot arrangement patterns according to the first exemplary embodiment.

FIG. 5 is a diagram illustrating dot arrangement patterns according to the present exemplary embodiment depending on the 9-value index data. As illustrated in FIG. 5, density (concentration) patterns according to the present exemplary embodiment, have four types of patterns for each of 9-value levels. Arrangement patterns of dots are defined with regard to each of 9-value of level 0 to level 8 which each index data indicates.

A region 2×4 composed of vertical 2-area and horizontal 4-area illustrated in FIG. 5, corresponds to one pixel output through halftone processing. The one pixel is a size corresponding to an area density of 600 dpi (dots/inch) both in vertical and horizontal. Each area which constitutes one pixel is a region where recording/non-recording of dots (discharge/non-discharge of inks) is defined, and in FIG. 5, an area that is painted out by "black" is an area where recording of dots is defined. Then, a number of areas is fixed where dot recording is defined, depending on either value of level 0 to level 8 which the index data indicates.

An area of one of these dot arrangement patterns corresponds to a size of recording density of 1200 dpi (vertical)× 2400 dpi (horizontal) in the printer according to the present exemplary embodiment. More specifically, the specification of the printer according to the present exemplary embodiment is designed so that it discharges ink droplets of 4 pl one by one from the recording head for each color, to one area of about 20 μm (vertical)×about 10 μm (horizontal), to form one dot. The dot arrangement patterning processing J0007 performs processing for binarizing 9-value data, using the above dot arrangement patterns, and generates 1-bit discharge data of "1" or "0" for discharge ports corresponding to respective areas and columns to be recorded.

Next, the mask data conversion processing J0008 performs mask processing, using a plurality of mask patterns which are in mutually complementary relationship, with respect to dot arrangements of each color decided by the dot arrangement patterning processing J0007. Accordingly, the mask data conversion processing J0008 generates discharge data for each scan which constitutes multi-pass, for each color of C, M, Y, and K. The patterns of masks used in the processing preferably use patterns made by manufacturing method discussed in Japanese Patent Application Laid-Open No. 2007-301989. The mask pattern is the one which has reduced interference with drive patterns involved in head driving of two rows of the nozzle arrays used in the next head drive circuit J0008. The mask pattern is the one which shows a high dispersability of recording permissible area pattern of the mask itself. Here, the recording permissible area of the mask is, when dot data corresponding to an area of mask where the recording permissible area is arranged, is "1" (discharged) or "0" (non-discharged), an area to which directly dot data of "1" or "0" is output, respectively. In contrast, recording non-permissible area is an area to which dot data of "0" is output, regardless of contents of the dot data.

The discharge data obtained by the mask processing is supplied to the head drive circuit J0009 at appropriate timings, at every plurality of times of scans in the multi-pass recording. Then, 1-bit data for each color input into the drive circuit J0009 as the dot data is allocated to two rows of the nozzle arrays, according to the drive patterns described below in FIG. 10 or the like, for each ink color. Then, drive pulses are supplied to the recording head 3 based on the allocated dot data, and inks are discharged at a predetermined timing from the recording head 311 for each color. Accordingly, ink discharge in accordance with the dot data is performed and recording of an image on the recording medium is performed. The data of the mask patterns, the drive patterns for multi-pass which will be described in following exemplary embodiments, is stored in a memory of the printer in advance. The above-described dot arrangement pattern processing and the mask data conversion processing in the printer are to be executed under control of the CPU that constitutes the control unit of the recording apparatus, using dedicated hardware circuit. Of the above-described conversion processing of image data, a part or all of the processing executed by the host apparatus may be performed on the printer side.

Figure 6:
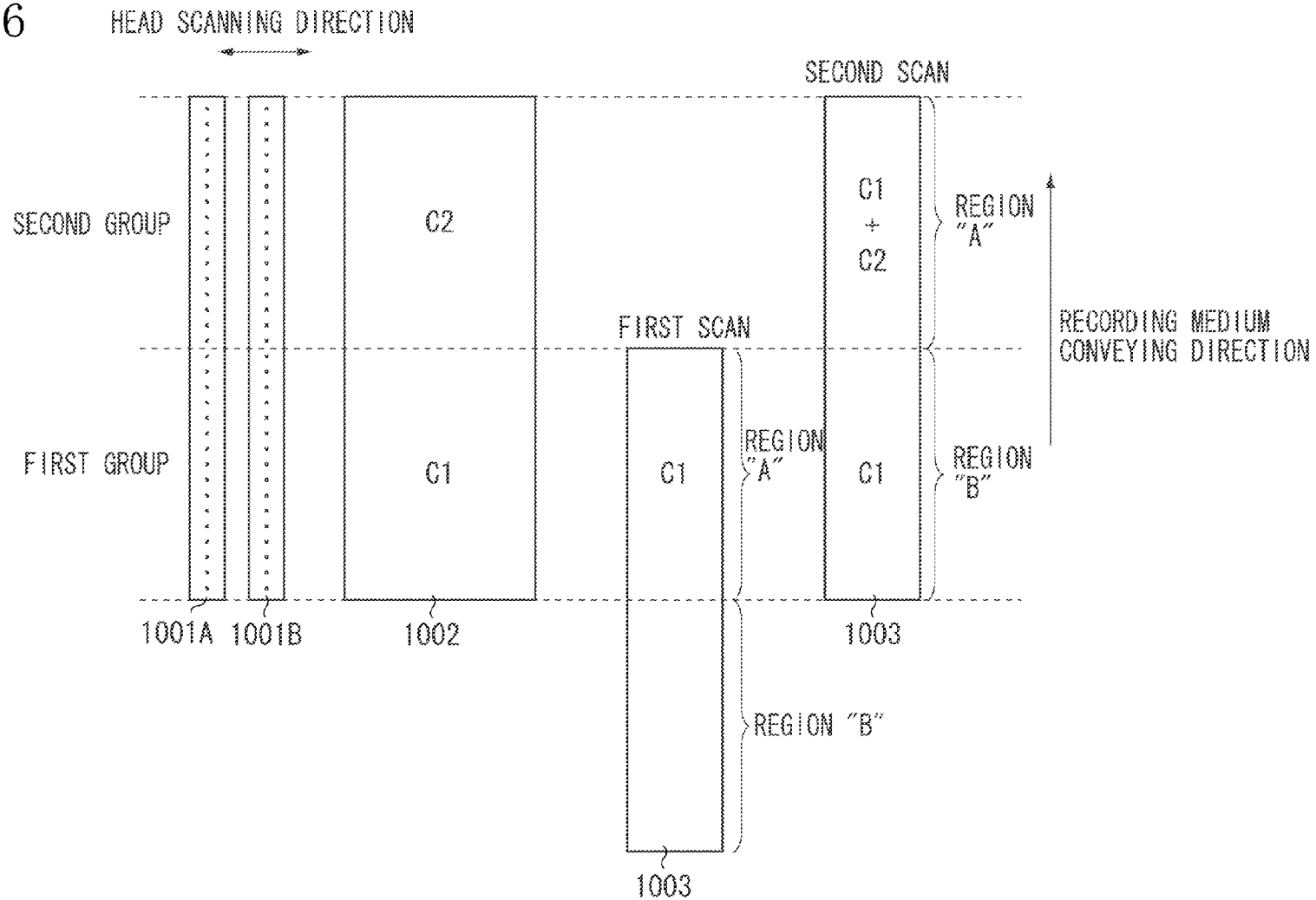
FIG. 6 is a diagram for explaining 2-pass recording according to the first exemplary embodiment.

FIG. 6 is a schematic diagram for explaining 2-pass recording. The recording head is provided with two nozzle arrays 1001A and 1001B for the same color, each of the nozzle arrays having 512 nozzles arranged at an interval of 1200 dpi. In a case of the 2-pass recording, each of the nozzle arrays is divided into a first group and a second group each including 256 nozzles. Each group is associated with each of discharge thinning masks 1002 (two masks C1 and C2), and sizes in a sub-scanning direction (conveyance direction) of respective masks C1 and C2 are equivalent to 256 areas portion which is the same as a number of nozzles of each group. The mask C1 and the mask C2 are in complementary relationship, and when these are overlapped with one another, recording of a region corresponding to 256 (horizontal) areas×256 (vertical) areas can be completed.

In the present exemplary embodiment, two nozzle arrays which can perform recording on the same area by performing one-time scan are used, for one color, and these two nozzle arrays are not distinguished therebetween in the mask processing itself. In other words, the mask C1 and C2 are commonly associated with the nozzle arrays 1001A and 1001B. Then, the dot data which have been subjected to the mask processing is allocated to two nozzle arrays according to the drive pattern by the drive circuit J0009. Its processing will be described below.

As illustrated in FIG. 6, in a first scan, recording is performed with respect to a region "A" in a recording medium 1003 using the mask C1, and recording is performed with respect to the region "A" using the mask C2, after the recording medium 1003 is fed by a distance of 256 areas portion. The recording of an image is completed by the two-time scans (passes).

Figure 7A:
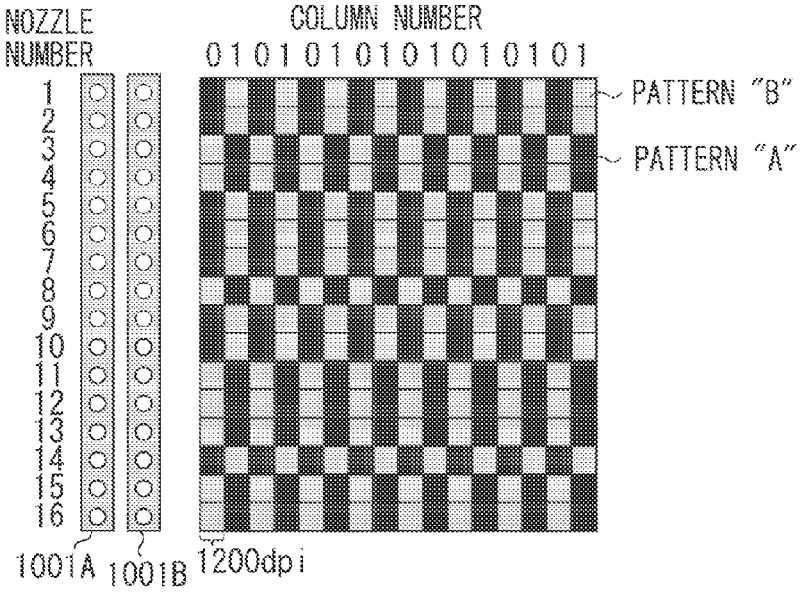
FIGS. 7A, 7B, and 7C are diagrams for explaining a recording method using drive patterns.
Figure 7B:
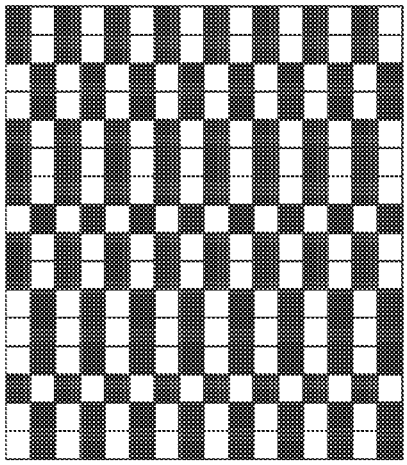
Figure 7C:
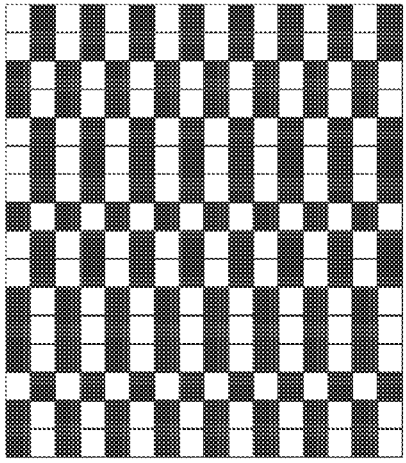

FIGS. 7A to 7C are diagrams for explaining the drive patterns. FIG. 7A illustrates two nozzle arrays 1001A and 1001B and indicates to which of these arrays the dot data is allocated to drive the nozzles. FIG. 7A is similar to FIG. 2. The nozzle arrays 1001A and 1001B are configured such that 512 nozzles are divided into 16 sections, and 32 nozzles belonging to one section are driven in a time-division fashion. In FIG. 7A, however, only 16 nozzles are illustrated.

Figure 1:
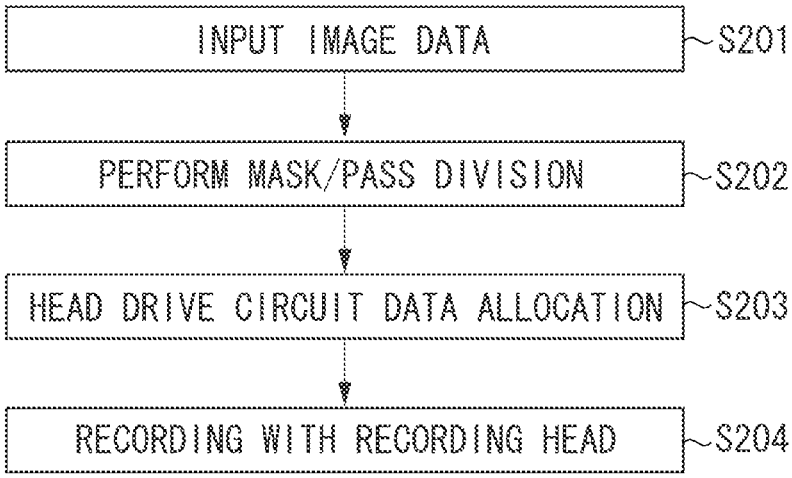
FIG. 1 is a diagram for explaining image data processing in a multi-pass recording.
Figure 2:
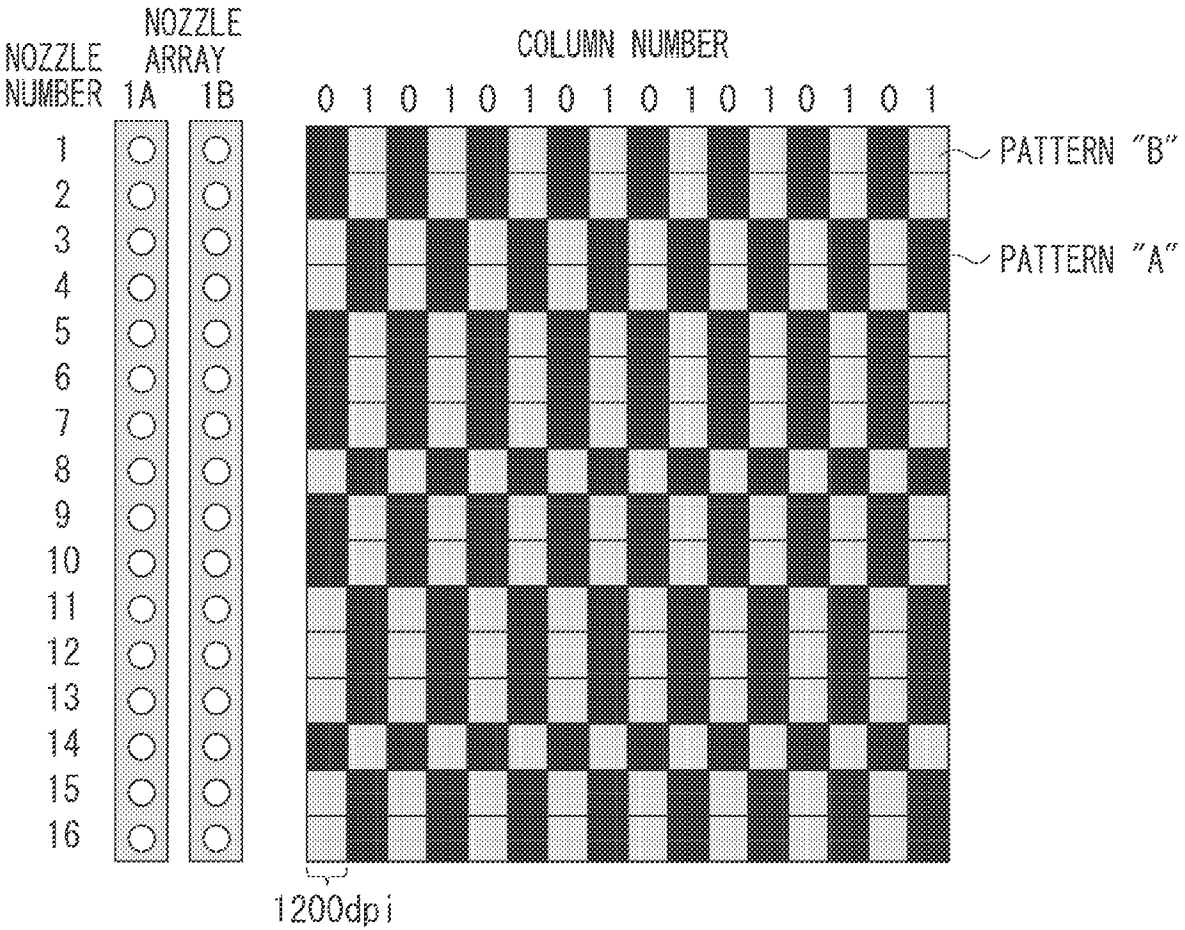
FIG. 2 is a diagram for explaining a recording method using drive patterns.

As explained in FIG. 2, with regard to the nozzle array 1001A, assignment of the dot data is performed according to the drive pattern "A", and for the nozzle array 1001B, assignment of the dot data is performed according to the drive pattern "B". Block enable signals for driving the nozzles in time-division fashion in sequence beginning at a nozzle with nozzle number 1 up to a nozzle with nozzle number 32 are input into each of the nozzle arrays (only 16 nozzles are illustrated in FIG. 2), and logical AND with the dot data assigned according to the drive patterns are performed, thus each of the recording elements is driven. More specifically, when a column (area array in vertical direction in FIG. 2) 0 is recorded, in the nozzle array 1001A, the recording elements corresponding to nozzles with nozzle numbers {1,2}, {5,6, 7}, 19,101, {14} are driven in this order. On the other hand, in the nozzle array 1001B, the recording elements corresponding to nozzles with nozzles number {3,4}, {8}, {11,12,13}, {15,16} are driven in this order. When a column 1 is recorded, in both the nozzle arrays 1001A and 1001B, recording is performed by time-division driving using complementary nozzles excluding the nozzles to be used in the column 0. For the column 2 or later, the dot data of the column 0, and the dot data of the column 1 are alternately assigned.

FIGS. 7B and 7C each illustrate drive permissible areas of the drive patterns "A" and "B". More specifically, each nozzle of the nozzle array 1001A is assigned the dot data according to the drive patterns in FIG. 7B, and is driven. Each nozzle of the nozzle array 1001B is assigned the dot data according to the drive patterns illustrated in FIG. 8C, and is driven. In the present exemplary embodiment, the drive patterns of staggered patterns as illustrated in FIGS. 7B and 7C are used, but, as a matter of course, the present invention is not limited to this. Any other patterns can be used as long as they achieve the effects as set forth in the present exemplary embodiment.

The first exemplary embodiment of the present invention is to change the drive patterns depending on a number of passes of the multi-pass recording, in a configuration for performing the multi-pass recording. More specifically, in the multi-pass recording, conveyance amount (feeding amount) between recording scan and recording scan varies depending on a number of passes. The drive pattern having a size in the conveyance direction depending on the feeding amount is to be selected. Each of the nozzle arrays according to the present exemplary embodiment is divided into a plurality of sections in order to perform recording by the time-division driving. As a result, a number of nozzles of one section of the time-division driving is also related to the drive patterns. More specifically, the drive patterns are decided by a relationship between the feeding amount and the number of nozzles of one section of the time-division driving. In the present exemplary embodiment, 32 nozzles belong to one section by dividing 512 nozzles into 16 sections.

First, the drive patterns at the time of 2-pass recording according to the present exemplary embodiment will be described. In the present exemplary embodiment, since the number of nozzles is 512, a feeding amount Nf is equivalent to 256 areas portion from a relationship with the number of nozzles of the recording head in 2-pass recording mode. Corresponding to this, in the present exemplary embodiment, the size of the drive pattern is to be equivalent to 32 areas portion in the conveyance direction (nozzles arranging direction), and a repetitive cycle Ng in the conveyance direction of the drive pattern is to be equivalent to 32 areas portion. More specifically, the repetitive cycle Ng (=32 areas) is to use the drive pattern that becomes a submultiple of the feeding amount Nf (=256 areas).

In the determining a size of the drive pattern, as large common divisor as possible (greatest common divisor) is desirable, out of common divisors between an feeding amount and a number of nozzles of one section. To design the drive pattern so as to avoid regular patterns is effective for enhancement of image quality. If the drive pattern are formed in a regular pattern, when dots are deviated from an ideal recording position in a certain pass, the entire dots are regularly deviated, which will cause image quality deterioration such as streaks. On the other hand, in a case of irregular pattern, since positions of deviated dots also become irregular, the deviated dots are unlikely to become streaks, and deterioration of image quality can be suppressed as a whole. In making the irregular pattern, irregularity can be increased by increasing cycle or size of the drive pattern.

Figure 8B:
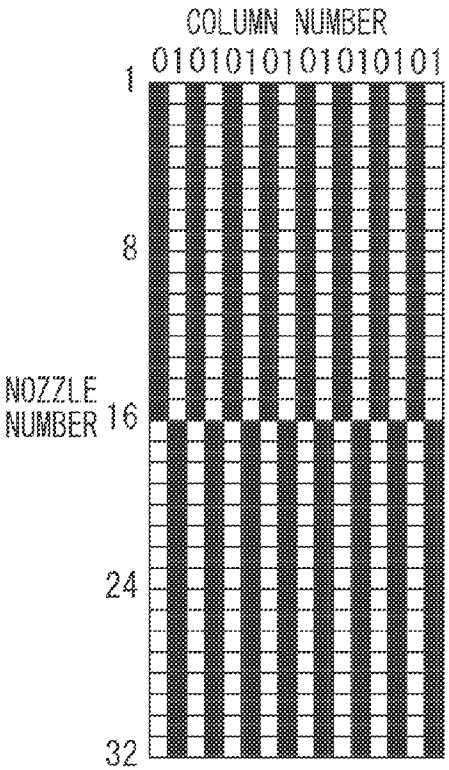
FIGS. 8A and 8B are diagrams illustrating a relationship between feeding amount and drive pattern cycle in 2-pass recording.
Figure 8A:
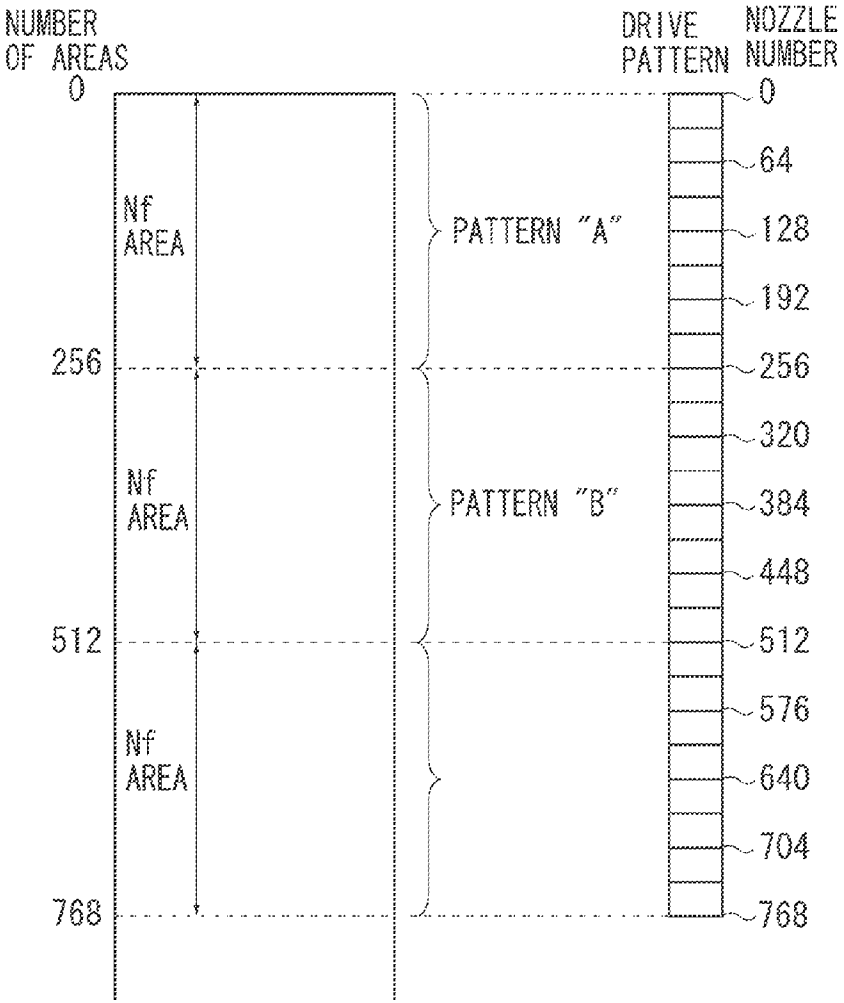

FIG. 8A illustrates a relationship between repetitive cycles of the drive patterns and feeding amounts at the time of 2-pass recording. FIG. 8B illustrates an example of the drive patterns of the 2-pass recording. Like FIG. 8A, sizes in the conveyance direction of the region "A" and the region "B", as unit regions where the recording is completed in the multi-pass recording, are equivalent to 256 areas portion and equal to a feeding amount Nf. In the present exemplary embodiment, a repetitive cycle Ng in the conveyance direction of the drive patterns is to be equivalent to 32 areas portion, and just eight nozzles are repeatedly used with respect to nozzles (256 nozzles) for recording each unit region. For this reason, for each unit region (region "A", region "B"), its uppermost pattern always starts from the same location of the repetitive cycle of the drive patterns.

In FIG. 8B, as an example of the drive pattern of the 2-pass recording, a pattern in which a size in the conveyance direction has become a cycle equivalent to 32 areas portion (32 nozzles portion) is indicated.

Figure 9B:
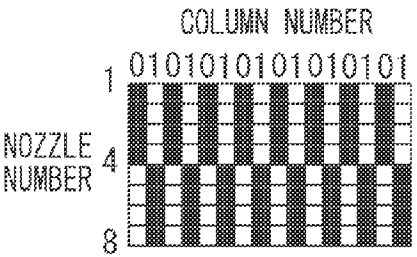
FIGS. 9A and 9B are diagrams illustrating a relationship between feeding amount and drive pattern cycle in 3-pass recording.
Figure 9A:
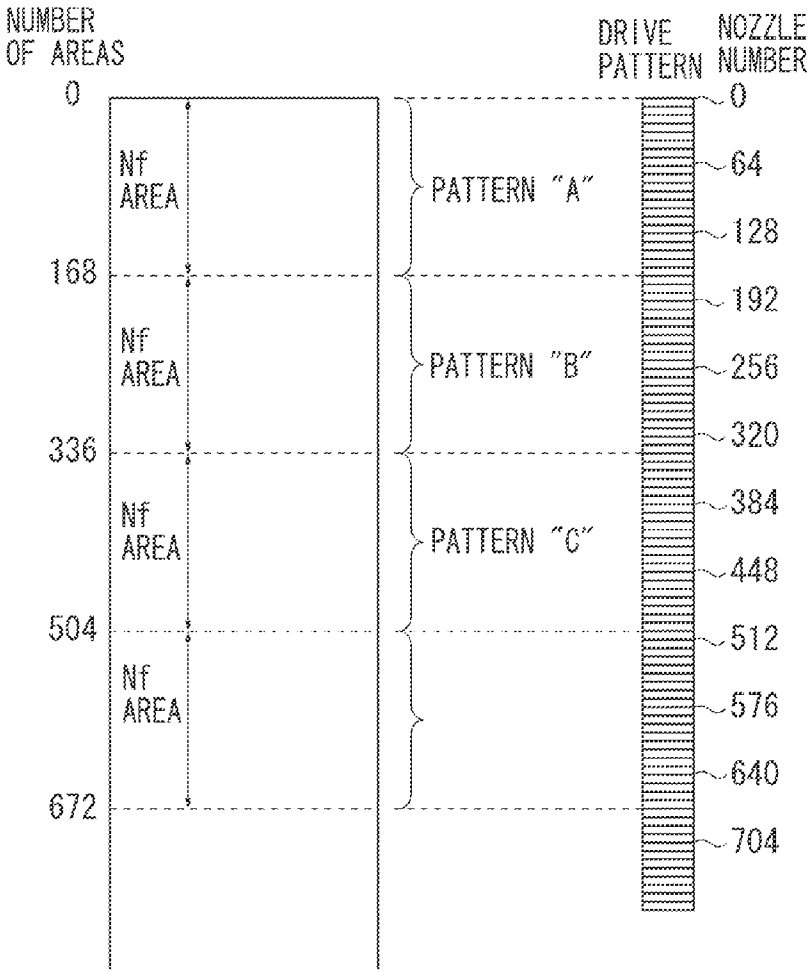

Next, FIG. 9A illustrates a relationship between a repetitive cycle of the drive patterns and a feeding amount at the time of 3-pass recording. FIG. 9B illustrates an example of the drive patterns of the 3-pass recording. In a case of the 3-pass recording, images to be recorded on a predetermined unit region of the recording medium are completed by three-time scan of the recording head. Of 512 nozzles of the nozzle arrays, 504 nozzles are divided into three groups of a first group, a second group and a third group corresponding to the unit regions. Here, a number of nozzles per one group is 168 because a numerical number close to 170.666 obtained by dividing 512 nozzles (equivalent to areas) by 3 is selected. A usage nozzle range (504 nozzles) at the time of the 3-pass recording can be decided as an arbitrary position within the nozzle array.

In FIG. 9A, a size in the conveyance direction of a region "A", a region "B", and a region "C" as the unit region is equal to a feeding amount Nf, which is equivalent to 168 areas portion. In the present exemplary embodiment, in a case of the 3-pass recording, the drive pattern where a repetitive cycle Ng in the conveyance direction becomes equivalent to 8 areas portion is used. A numeric value of the equivalent of 8 areas is a greatest common divisor between a feeding amount (168 areas portion) and a number of nozzles (32) of one section. Therefore, the drive pattern is designed to be repeatedly used in every group of just 21 pieces relative to nozzles (168 nozzles) which record each unit region (the region "A", the region "B", and the region "C"). For this reason, the uppermost position of each unit region starts always from the same location of the repetitive cycle of the drive patterns.

In a case of the 3-pass recording, a number of nozzles of one group that perform recording of the unit region by one-time recording scan is 168, which is not a multiple of 32 as a number of blocks of the time-division driving. For this reason, the driving order of the blocks will be different in each of a plurality of times of scanning the unit region. However, in the present exemplary embodiment, a size in the conveyance direction of the drive pattern is matched with the conveyance amount. Since in each region, the dot arrangement is the same, in the unit region after a plurality of times of scans has been performed, degradation of image quality can be suppressed.

More specifically, the drive pattern defines recording order of the dots, using its size as a unit. On the other hand, a region to be completed by the multi-pass recording is a dot arrangement unit binarized by a density (concentration) pattern matrix. In this way, by matching an unit of the drive pattern that defines recording operation (in the order of recording of dots) with a recording image unit of an image processing (pass mask processing), an image with a high quality can be realized, without degrading the effect of pass mask such as dispersability of dots.

FIG. 9B illustrates a pattern in which a size in the conveyance direction becomes a cycle equivalent to 8 areas portion (8 nozzles portion), as an example of the drive patterns of the 3-pass recording.

Figure 10:
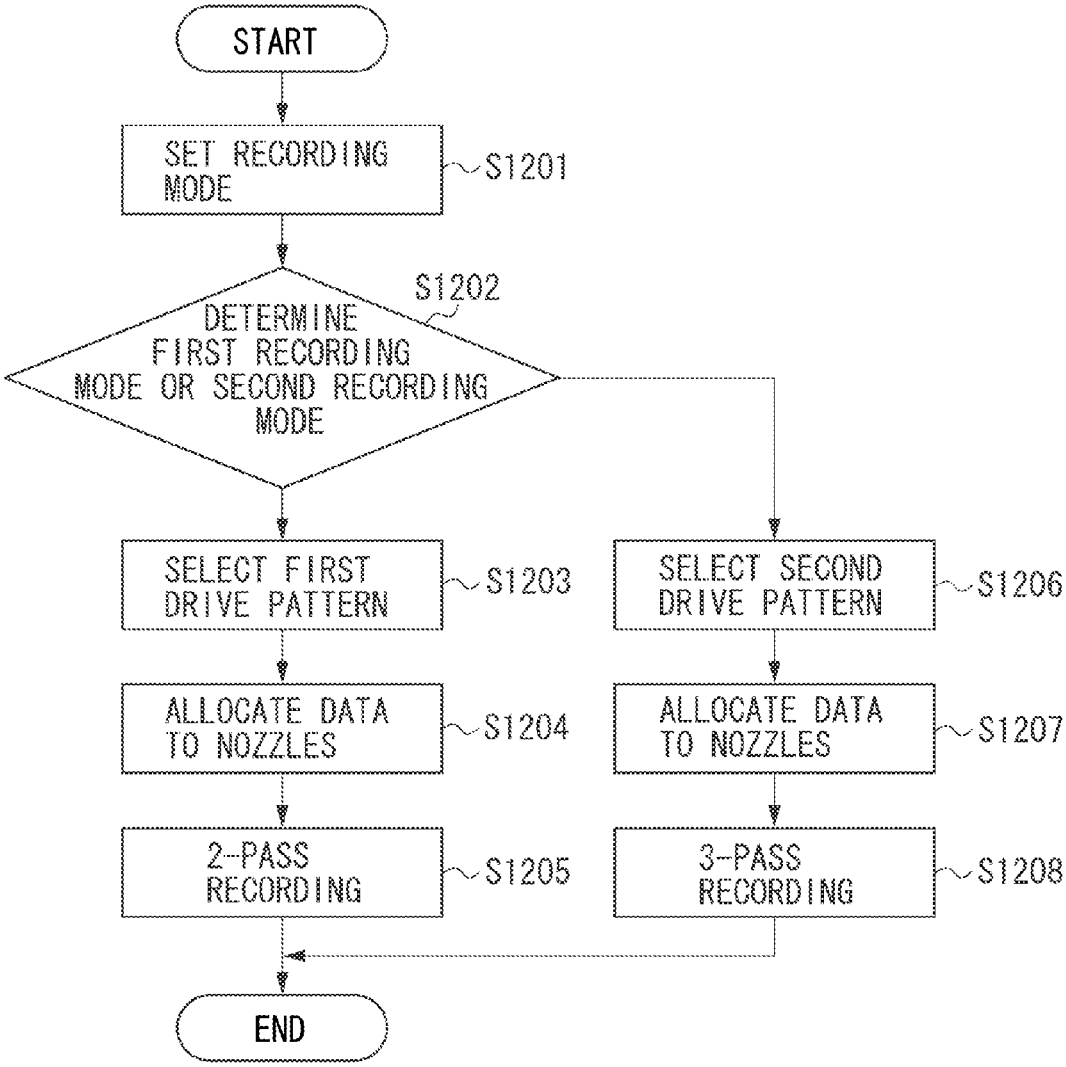
FIG. 10 is a flowchart illustrating change processing of the drive patterns according to the first exemplary embodiment.

FIG. 10 is a flowchart illustrating processing performed along with recording operation according to the present exemplary embodiment. In particular, the flowchart illustrates change processing of the drive patterns along with change of a number of passes of the multi-pass recording.

First, in step S1201, in the host apparatus, one recording mode selected from a plurality of recording modes in which a number of passes is specified, is set. In this process, selection of the recording modes may be manually performed by a user, or may be automatically performed by the host apparatus depending on the image data. Then, the thus selected recording mode is set in the host apparatus as the recording mode to be used in the recording. Next, in step S1202, it is determined whether the set recording mode is a first recording mode or a second recording mode. Here, the first recording mode is a mode for performing the 2-pass recording, and more specifically, is a recording mode for completing recording of the unit region by M times (M is an integer of two or greater, M=2 in this case) by scanning while performing conveyance operation therein based on a first conveyance amount (Nf=256 areas portion). On the other hand, the second recording mode is a mode for performing the 3-pass recording, and more specifically, is a recording mode for completing recording of the unit region by N times (N is an integer of two or greater which is different from M, N=3 in this case) by scanning while performing conveyance operation based on a second conveyance amount (Nf=168 areas portion).

Next, in step S1202, if it is determined that the first recording mode has been set, the processing proceeds to step S1203, and the first drive pattern to be used as the drive pattern is decided. In this process, a size in the conveyance direction of the first drive pattern is a size of 32 areas, as explained in FIG. 8, and this is a submultiple of the first conveyance amount Nf (=256 areas portion). Next, the dot data for the 2-pass recording distributed for two times of scans is allocated to nozzles of the nozzle arrays using the first drive pattern elected in step S1204. This processing corresponds to J0009 processing in FIG. 5. Accordingly, drive pulses are supplied to the recording head, and inks are discharged at a predetermined timing from the recording head, and recording operation is performed by scanning two times. This processing corresponds to J0010 in FIG. 5.

On the other hand, in step S1202, if it is determined that the second recording mode has been set, the processing proceeds to step S1206, and a second drive pattern is decided to be used as the drive pattern. In this process, a size in the conveyance direction of the second drive pattern is a size of 8 areas, as explained in FIG. 9, which is a submultiple of the second conveyance amount (Nf=168 areas portion). Next, the dot data for the 3-pass recording distributed for three times of scans is allocated to nozzles of the nozzle arrays using the second drive pattern elected in step S1207. This processing corresponds to J0009 processing in FIG. 5. Accordingly, drive pulses are supplied to the recording head, inks are discharged at the predetermined timing from the recording head, and recording is performed by scanning three times. This processing corresponds to J0010 in FIG. 5.

Thus in the present exemplary embodiment, as described above, a size of the drive pattern is changed depending on a number of passes specified depending on the conveyance amount, that is, the recording mode. At this time, a repetitive cycle is decided such that the size of the conveyance direction of the drive pattern becomes a submultiple of the conveyance amount. Accordingly, a repetitive cycle of the drive pattern can be generated in a similar manner in any of the unit regions. Therefore, it is possible to avoid mismatch between regions (unit regions) under recording operation and the repetitive cycle of binarizing processing pattern in the image processing, and to realize image recording with a high quality.

In the present exemplary embodiment, although the 2-pass mode is employed as the first recording mode, and the 3-pass mode is employed as the second recording mode as an example, a number of passes that can be employed in the present exemplary embodiment is not limited to this. For example, a configuration in which the first recording mode is 4-pass mode, and the second recording mode is 3-pass mode may be used. A configuration in which the third recording mode is further provided, and the first recording mode is 2-pass mode, the second recording mode is 3-pass mode, and the third recording mode is 4-pass mode, may be used. Any configuration may be used, as long as a repetitive cycle of the drive pattern is a submultiple of the conveyance amount.

As described above, in the present exemplary embodiment, the drive patterns are used for allocating data to a plurality of nozzle arrays, in the multi-pass recording for completing recording of the unit regions of the recording medium by a plurality of times of scans of the recording head while performing conveyance operation of the recording medium. Then, the drive pattern is decided such that it can execute a plurality of multi-pass recording modes with different conveyance amounts, and a repetitive cycle in the conveyance direction of the drive pattern becomes a submultiple of the above-described conveyance amount. Accordingly, since the repetitive cycle of the drive pattern becomes the submultiple of the conveyance amount, regardless of the conveyance amount, influence of beading can be reduced and degradation of image quality can be suppressed.

The second exemplary embodiment of the present invention, further at the time of recording mode for performing column thinning, the drive pattern is changed to a size depending on an feeding amount and a number of thinned columns. A column thinning is a method for performing recording with increased scan speed of the recording head, by limiting columns to which ink is discharged during one scan when performing multi-pass recording.

Figure 11:
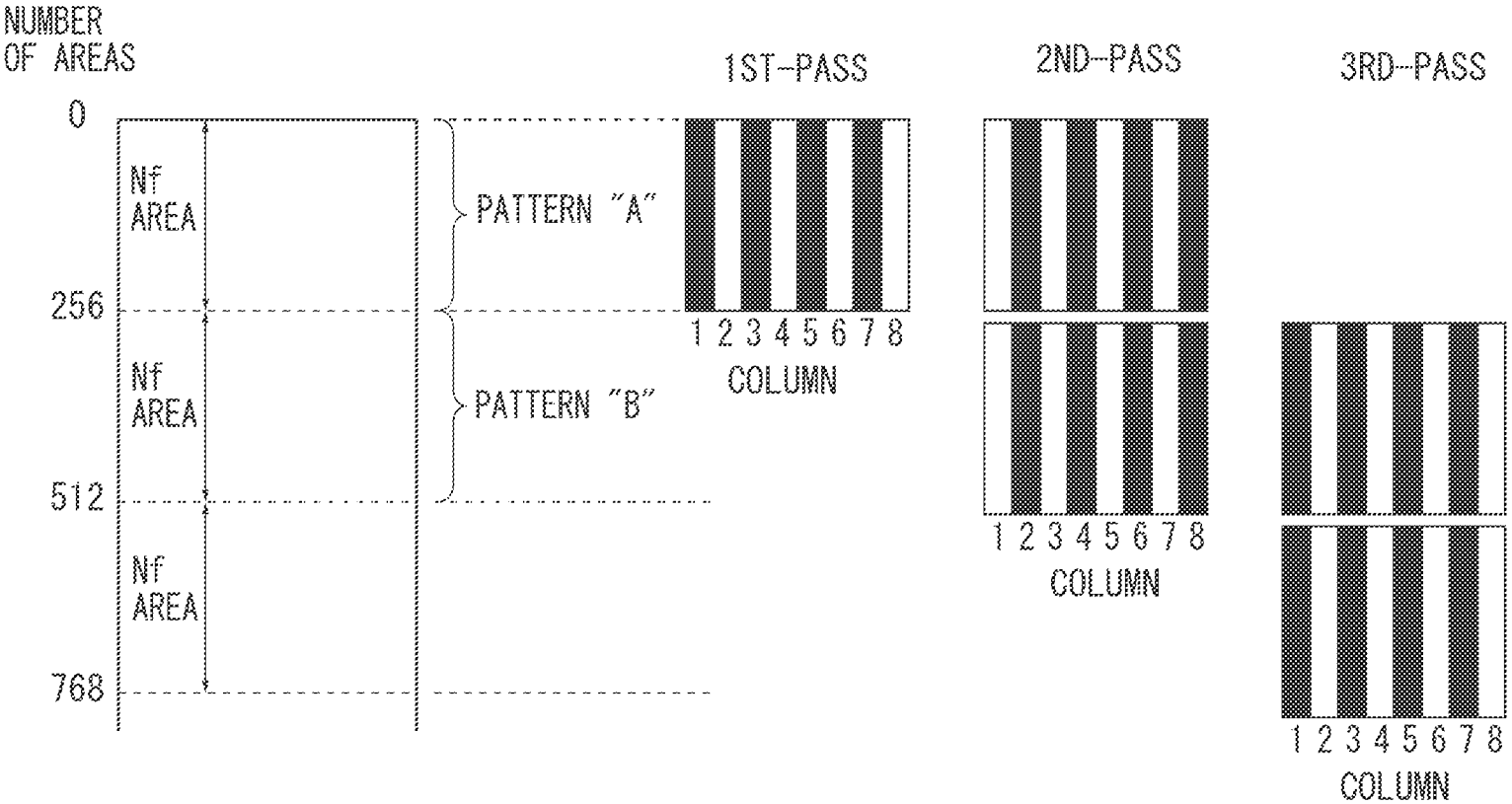
FIG. 11 is a diagram for explaining process of an image formation by column thinning.

FIG. 11 illustrates image formation process when 2-column thinning is performed. As illustrated in FIG. 11, in a region "A", images are formed every other column from a first column during a first pass, and the remaining images are formed during a second pass. On the other hand, on a lower region "B", images are formed every other column from the second column during the second pass, and the remaining images are formed during a third pass. In other words, dots overlap with one another in a different order between the unit region "A" and the unit region "B" by the 2-column thinning thereby carrying out image formation. Therefore, a cycle in which recording is repetitively performed in a region combining the unit region "A" and the unit region "B" can be deemed as a repetitive cycle, and thus a cycle of the drive pattern may be matched with the enlarged region. In other words, when the column thinning is performed, a size in the scanning direction of the drive pattern can be set to a common divisor between a value of the product of a feeding amount and a number of thinned columns, and a number of nozzles in one section. Hereinbelow, a column thinning for forming images every other column is referred to as 2-column thinning.

When the 2-column thinning is performed in the 2-pass recording, a size in the conveyance direction of the drive pattern becomes a common divisor between a value 512 of the product of an feeding amount (=256 areas) and a number of thinned columns (=2), and a number of nozzles 32 in one block. In this case, since a greatest common divisor is 32, the size in the feed direction of the drive pattern is equivalent to 32 areas. Accordingly, the uppermost position of the unit region always starts from the same location of the drive pattern.

Next, a case where the 2-column thinning is performed in a 6-pass recording will be described. In a case of the 2-column thinning, a cycle of the drive pattern becomes a common divisor between a value 168 of the product of a feeding amount (=84 areas) of 6-pass and a number of thinned columns (=2), and a number of nozzles 32 in one block. In this case, since a greatest common divisor is 8, a cycle in the conveyance direction of the drive pattern is set to 8 areas.

Accordingly, since a unit of the drive pattern that defines recording operation (in the order of recording of dots) and a recording image unit of the image processing (pass mask processing) can be matched with each other, high-quality images can be realized without degrading the effects of the pass mask such as dispersability of the dots.

Other Embodiments

Figure 12:
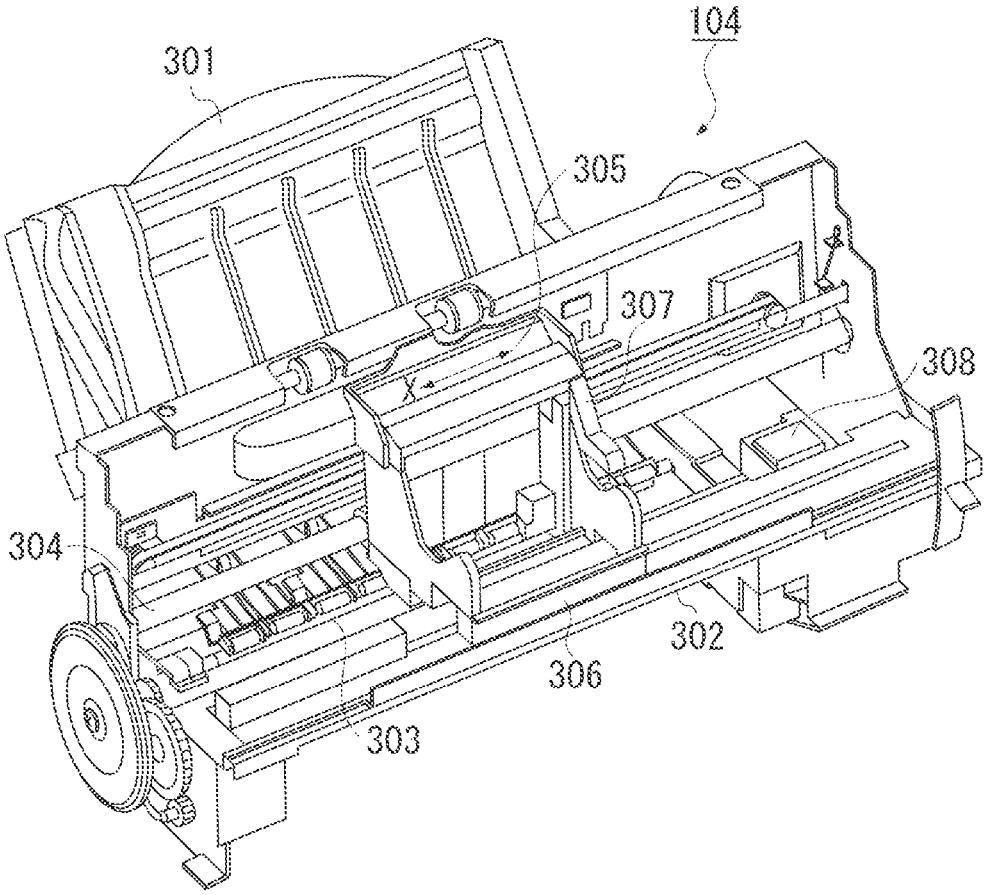
FIG. 12 is an outer appearance perspective view of an inkjet recording apparatus to which the present invention is applicable.

While referring to FIG. 12, a printer as an inkjet recording apparatus to which the above-described exemplary embodiments can be applied will be described. The printer 104 includes an automatic sheet feeding unit 301 that automatically feeds a recording medium such as paper to the apparatus main body, and a sheet conveyance unit 303 that guides the recording medium fed one by one from the automatic sheet feeding unit 301 toward a predetermined recording position and guides it from the recording position toward a sheet discharge portion 302. The printer 104 further includes a recording unit that performs desired recording on the recording medium conveyed to the recording position, and a recovery unit 308 that performs recovery processing on the recording unit.

The recording unit includes a carriage 305 supported movably in the main-scanning direction as shown by an arrow "X" by a carriage shaft 304, and a recording head 311 (not illustrated) mounted attachably and detachably to the carriage 305. The carriage 305 is provided with a carriage cover 306 for guiding the recording head 311 to a predetermined attachment position on the carriage 305, in engagement with the carriage 305. Furthermore, the carriage 305 is also provided with a head set lever 307 that is pressed against the recording head 311 so as to set it up to the predetermined attachment position, in engagement with a tank holder 113 of the recording head 311.

There is provided a head set plate (not illustrated) rotatably provided with respect to the head set lever shaft on the top of the carriage 305, and spring-urged at an engagement portion with the recording head 311. The head set lever 307 is configured to attach the recording head 311 to the carriage 305, while being pressed against the recording head 311, by the spring force.

Figure 13:
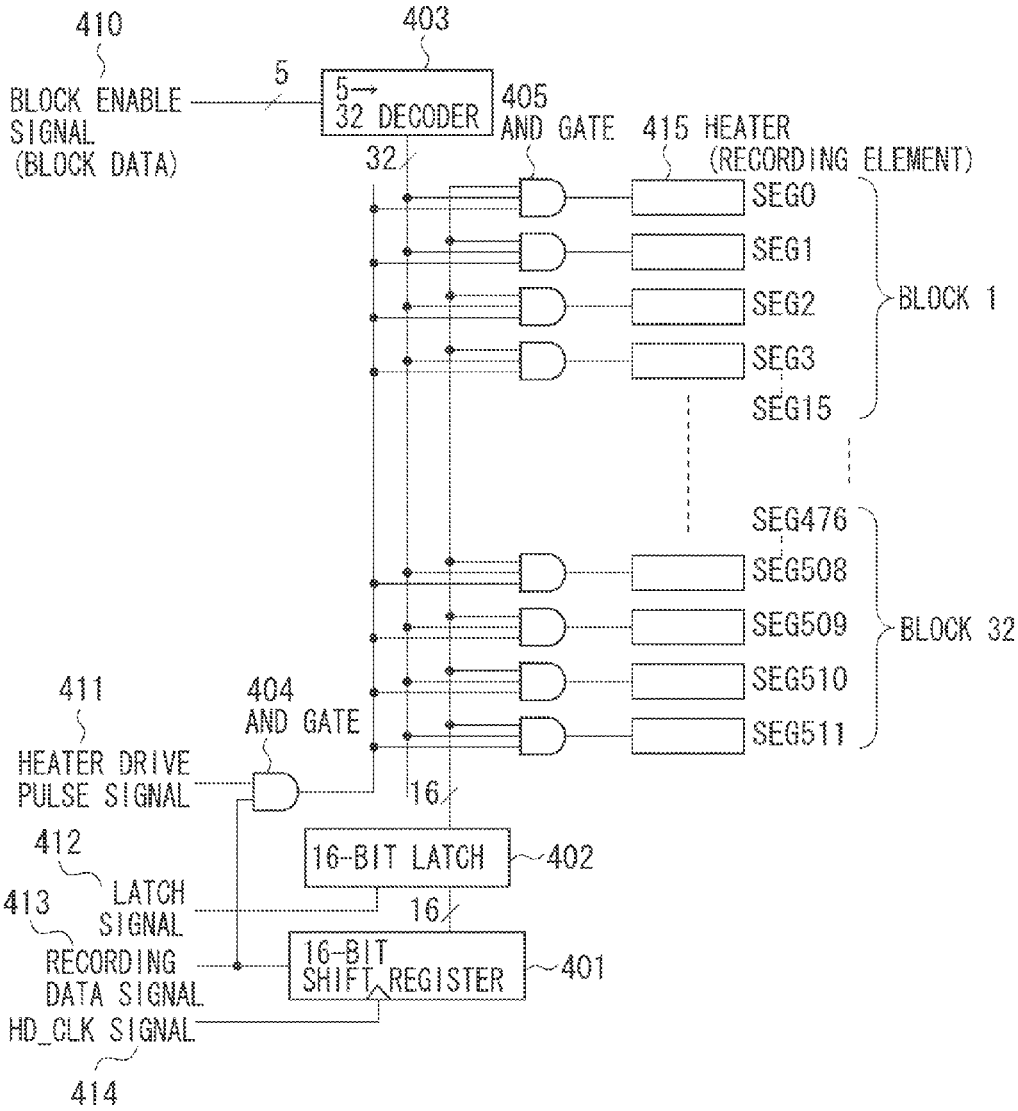
FIG. 13 is a drive circuit diagram of the recording head.

FIG. 13 is a drive circuit diagram for driving the recording head 311. The recording head 311 drives 512 pieces of recording elements by dividing them into 32 blocks, and simultaneously drives 32 pieces of the recording elements 415 allocated to the same blocks. A recording data signal 413 is sent serially transferred in response to an HD_CLK signal 314 to the recording head 311. The recording data signal 413, after having been received by a 16-bit shift register 401, is latched by ramp-up of a latch signal 412 at a 16-bit latch 402. Designation of blocks is indicated by five block enable signals 410, and the recording elements of the designated block rasterized by a decoder 403 are selected. Only the recording elements 415 designated by both the block enable signals 410 and the recording data signal 413 are driven by a heater drive pulse signal 411 that has passed through AND gates 405, to discharge the ink droplets thereby carrying out image recording.

While the above-described exemplary embodiments are described using the time-division driving scheme for sequentially driving physically continuous recording elements, a distributed drive scheme of a discrete type, which sequentially drives the recording elements at discrete positions can be also applied to the present invention.

Further, in the above-described exemplary embodiments, when a plurality of recording modes is carried out with different numbers of recording passes, it is not necessary to vary sizes of the drive pattern according to respective recording modes. For example, when 2-pass mode, 3-pass mode, and 4-pass mode are executable, the drive patterns may be commonly used in the 2-pass and the 4-pass. Further, the drive patterns used in each recording mode are not limited to a configuration in which they are stored in a ROM in advance in association with each recording mode. Another configuration may be used such as, for example, to prepare a set of the drive patterns with a wide range in advance, clipping to a size in the conveyance direction depending on the set recording mode, and using it.

Further, in the above-described exemplary embodiments, an example is illustrated, in which numbers of passes of the multi-pass recording of each recording mode are different from one another, and accordingly conveyance amounts are also different from one another. However, in a configuration in which numbers of nozzles to be used are varied from recording mode to recording mode, respective conveyance amounts will be different from one another, even when the numbers of passes are the same. The present invention can be applied to such configuration. In this case, a size in the conveyance direction of the drive pattern has only to vary depending on the conveyance amount of each recording mode.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-019440 filed Jan. 29, 2010, which is hereby incorporated by reference herein in its entirety.

What is claimed is:

1. A recording apparatus that performs recording using a plurality of nozzle arrays for discharging same-colored inks, the recording apparatus comprising:

a driving unit, with regard to each of the plurality of nozzle arrays, configured to divide recording elements provided corresponding to nozzles into a plurality of blocks, and to drive every group of recording elements that belong to same blocks;

an allocation unit configured to allocate dot data to the plurality of nozzle arrays according to a drive pattern that defines an area where driving of the recording elements by the driving unit is permitted; and a control unit configured to perform recording in a first recording mode for performing recording by conveying a recording medium by a first conveyance amount in a conveyance direction, or in a second recording mode for performing recording by conveying the recording medium by a second conveyance amount which is non-integral multiple of the first conveyance amount in the conveyance direction, wherein the allocation unit allocates the dot data according to the drive pattern having a size in the conveyance direction equivalent to a submultiple of the first conveyance amount in the first recording mode, and allocates the dot data according to the drive pattern having a size in the conveyance direction equivalent to a submultiple of the second conveyance amount in the second recording mode.

2. The recording apparatus according to claim 1, further comprising:

a unit for storing the drive patterns corresponding to each of the first recording mode and second recording mode, wherein the allocation unit selects a drive pattern from among the stored drive patterns according to the recording mode executed by the control unit.

3. The recording apparatus according to claim 1, wherein a size of the drive pattern in the conveyance direction used in the first recording mode is a greatest common divisor between the first conveyance amount and a number of recording elements belonging to the same blocks, a size of the drive pattern in the conveyance direction used in the second recording mode is a greatest common divisor between the second conveyance amount and a number of recording elements belonging to the same blocks.

4. The recording apparatus according to claim 1, wherein the first recording mode is a recording mode for performing recording by causing the plurality of nozzle arrays to perform a plurality of times of scans on a region of a recording medium in which a size in the conveyance direction is equivalent to the first conveyance amount, and the second recording mode is a recording mode for performing recording by causing the plurality of nozzle arrays to perform a plurality of times of scans on a region of a recording medium of which size in the conveyance direction is equivalent to the second conveyance amount.

5. The recording apparatus according to claim 1, wherein the first recording mode and second recording mode are recording modes for performing recording at intervals of a predetermined number of columns in scanning at one time, and wherein the allocation unit, in the first recording mode, uses the drive pattern having a size in the conveyance direction equivalent to a submultiple of the product of the first conveyance amount and the predetermined number, and in the second recording mode, uses the drive pattern having a size in the conveyance direction equivalent to a submultiple of the product of the second conveyance amount and the predetermined number.

6. A method for performing recording by dividing recording elements provided corresponding to nozzles into a plurality of blocks and driving every group recording elements belonging to same blocks, with regard to a plurality of nozzle arrays for discharging same-colored inks, the method comprising:

allocating dot data to the plurality of nozzle arrays according to a drive pattern that defines an area where driving of the recording elements is permitted; and performing recording in a first recording mode for performing recording by conveying a recording medium by a first conveyance amount in a conveyance direction, or in a second recording mode for performing recording by conveying the recording medium by a second conveyance amount which is a non-integral multiple of the first conveyance amount in the conveyance direction, wherein in the allocating, the dot data is allocated according to the drive pattern having a size in the conveyance direction equivalent to a submultiple of the first conveyance amount, in the first recording mode, and the dot data is allocated according to the drive pattern having a size in the conveyance direction equivalent to a submultiple of the second conveyance amount, in the second recording mode.

7. The recording method according to claim 6, wherein, in the allocating, a drive pattern corresponding to the first recording mode or a drive pattern corresponding to the second recording mode are used, according to recording mode executed in the recording.

8. The recording method according to claim 6, wherein a size of the drive pattern in the conveyance direction used in the first recording mode is a greatest common divisor between the first conveyance amount and a number of recording elements belonging to the same block, and a size of the drive pattern in the conveyance direction used in the second recording mode is a greatest common divisor between the second conveyance amount and a number of recording elements belonging to the same blocks.

9. The recording method according to claim 6, wherein the first recording modes is a recording mode for performing recording by causing the plurality of nozzle arrays to perform a plurality of times of scans on a region of a recording medium of which size in the conveyance direction is equivalent to the first conveyance amount, and the second recording mode is a recording mode for performing recording by causing a plurality of nozzle arrays to perform a plurality of times of scans, on a region of recording medium in which a size in the conveyance direction is equivalent to the second conveyance amount.

10. The recording method according to claim 6, wherein the first recording mode and second recording mode are recording modes for performing recording at intervals of a predetermined number of columns, and wherein, in the allocating, the drive pattern having a size in the conveyance direction equivalent to a submultiple of the product of the first conveyance amount and the predetermined number is used in the first recording mode, and the drive pattern having a size in the conveyance direction equivalent to a submultiple of the product of the second conveyance amount and the predetermined number is used in the second recording mode.

* * * * *